US011890511B2

(12) United States Patent
Chiang et al.

(10) Patent No.: US 11,890,511 B2
(45) Date of Patent: Feb. 6, 2024

(54) SWIMMING GOGGLES

(71) Applicant: Global Esprit Inc., New Taipei (TW)

(72) Inventors: Herman Chiang, New Taipei (TW); Tsai-Tung Wang, New Taipei (TW)

(73) Assignee: GLOBAL ESPRIT INC., New Taipei (TW)

( * ) Notice: Subject to any disclaimer, the term of this patent is extended or adjusted under 35 U.S.C. 154(b) by 160 days.

(21) Appl. No.: 17/737,996

(22) Filed: May 5, 2022

(65) Prior Publication Data

US 2023/0293947 A1 Sep. 21, 2023

(30) Foreign Application Priority Data

Mar. 18, 2022 (TW) ..... 111202756

(51) Int. Cl.
*A63B 33/00* (2006.01)

(52) U.S. Cl.
CPC ..... *A63B 33/002* (2013.01)

(58) Field of Classification Search
CPC ... A63B 33/002; A63B 33/004; A63B 33/006; A63B 33/008; B63C 11/12; B63C 2011/125; B63C 2011/128; A61F 9/028; A61F 9/02; A61F 9/025; A61F 9/026; A61F 9/027; A61F 9/029
See application file for complete search history.

(56) References Cited

U.S. PATENT DOCUMENTS 2,410,184 A * 10/1946 Schauweker ..... A61F 9/028 2/437
2,420,106 A * 5/1947 Splaine ..... A61F 9/028 2/437
2,877,463 A * 3/1959 Watkins ..... A61F 9/028 2/184.5
3,031,675 A * 5/1962 Dubach ..... A61F 9/028 2/437
3,141,172 A * 7/1964 Hirschmann ..... A61F 9/028 2/436
6,247,187 B1 * 6/2001 Chiang ..... A63B 33/006 2/445
6,611,966 B1 * 9/2003 Yamamoto ..... A61F 9/028 2/436
6,832,394 B1 * 12/2004 Chiang ..... A63B 33/004 2/452
2007/0186332 A1 * 8/2007 Chiang ..... A63B 33/004 2/448
2009/0038060 A1 * 2/2009 Chiang ..... A63B 33/004 2/440
2009/0241246 A1 * 10/2009 Eun ..... A63B 33/004 2/436
2011/0007394 A1 * 1/2011 Song ..... A63B 33/004 359/507
2021/0106876 A1 * 4/2021 Chiang ..... G02C 11/08

* cited by examiner

*Primary Examiner* — Amy Vanatta
(74) *Attorney, Agent, or Firm* — Leong C. Lei

(57) ABSTRACT

This invention provides a swimming goggles, which takes the frames as the core, combines the two lenses of the goggles, nose bridge connecting part, two protective pads, headband device and other components into a whole, and provides a protective cover for the waterproof-ventilation film on the lenses, so that the waterproof-ventilation film cannot be touched improperly by external forces when in use. Moreover, by the flexible arrangement of the frames and nose bridge connecting part of the goggles, users with different nose bridge and different facial contours can wear comfortably.

20 Claims, 7 Drawing Sheets

SWIMMING GOGGLES

BACKGROUND OF THE INVENTION

Technical Field of the Invention

This invention relates to swimming goggles, are more particularly, to swimming goggles with the structure that is with waterproof and ventilation effect and provides comfort and fit experience for users with different sizes of nose bridge and different facial contours.

Description of Related Art

The fog formed on the swimming goggles is mainly caused by the temperature difference between the side where the goggles contacts with water and the side where the goggles near the eyes. During swimming, the swimmer emits high hot air from one side of the eyes. Once they contact with the low temperature water, the hot air at one side of the eyes cannot evaporate under the seal, and thus it gradually coagulates into fog. A related art method to overcome the fogging of the goggles lenses can be sticking an anti-fogging film on the inner surface of the lenses, resorting to anti-fogging treatment, or directly using an anti-fogging plate as the lenses. However, no matter which method is adopted, it is only anti-fogging but without ventilation, and the effect is thus not as good as expected.

Besides, due to the structural factors of goggles, the goggles often do not fit the swimmers with different facial contours and different heights of nose bridge, especially those with wider face or higher nose bridge. Therefore, how to make goggles suitable for users with different heights of nose bridge and facial contours comfortable upon wearing is highly expected.

In view of the above, the inventor of the present application provides the present invention based on many years working experiences combining the design and developed of swimming goggles.

SUMMARY OF THE INVENTION

The purpose of the present application is to provide swimming goggles which use the two frames as a core that combines the two lenses, the nose bridge connecting part, the two protective pads and the headband device as a whole. Specifically, the swimming goggles functions as protective measures with the waterproof-ventilation film on the lenses, and serves as a kind of swimming goggles which is comfortable to wear, and provides waterproof and ventilation effects.

In order to achieve the above objective, the present invention provides a swimming goggles comprising two frames, a nose bridge connecting part that connects the two frames, two lenses respectively assembled on the two frames and provided with ventilation windows with waterproof-ventilating films, a protective pad assembled on the lenses, and a headband device connected to each of the frames or each of the lenses. The swimming goggles is characterized in that each of the frames is provided with a protective cover relative to the ventilation window of each of the lenses, which can prevent the waterproof-ventilation film from being improperly touched by external forces upon using the swimming goggles.

According to the above, each of the lenses includes: a front plane and an torus integrally extending along the periphery of the front plane; and a convex lip integrally extending along the periphery of the torus for assembling with the assembly groove of the protective pad, wherein the front plane is wider in X-axial direction than in Y-axial direction, and one side of the torus opposite to the X-axis of the front plane is provided with the ventilation window.

According to the above, the protective cover on each of the frames is a tongue piece, and the tongue piece is integrally arranged along the concave surface of the frame so as to keep distant from the concave surface and cover thereon, and the tongue piece is provided with a plurality of hollow grooves for ventilation.

According to the above, each of the frame forms a lower concave surface opposite to the tongue piece, and the lower concave surface is covered with thermoplastic rubber (TPR) and protrudes with an extension section, and the tail end of the extension section is connected with a side buckle of the headband device, and the side buckle has a through hole for the headband of the headband device to pass through.

Another feature of swimming goggles of the present invention is that a first assembly is arranged between each of the two frames and the nose bridge connecting part, and a second assembly is arranged among each of the frames, each of the lenses, and protective pad; the first assembly is further provided with a plurality of convex bodies and grooves which are connected with each other between each of the frames and a side of the nose bridge connecting part, so that during molding, the convex bodies and grooves make each of the frames and the nose bridge connecting part have increased gripping effect; the second assembly forms groove along the convex lip of each of the lenses, and the groove is concave towards the torus of each of the lenses; the width of the groove is smaller than the width of each of the frames plus the peripheral length of the contour of each of the protective pads that is assembled with each of the lenses, so that each of the frames is firmly assembled in the groove in an interference manner during assembly.

Another feature of swimming goggles of the present invention is that two fitting parts are arranged between each of the frames and each of the lenses, and the two fitting parts are respectively located along the X-axis and the Y axis relative to each of the lenses, and each of the fitting parts located along the X-axis is provided with a first insert groove on each of the frames adjacent to the nose bridge connecting part, and is provided with a raised ridge relative to each of the lenses; and each of the fitting parts located in the Y-axis is provided with a convex edge at the center of each of the lenses, and a second insert groove is opposite to each of the frames.

DETAILED DESCRIPTION OF THE INVENTION

Figure 1:
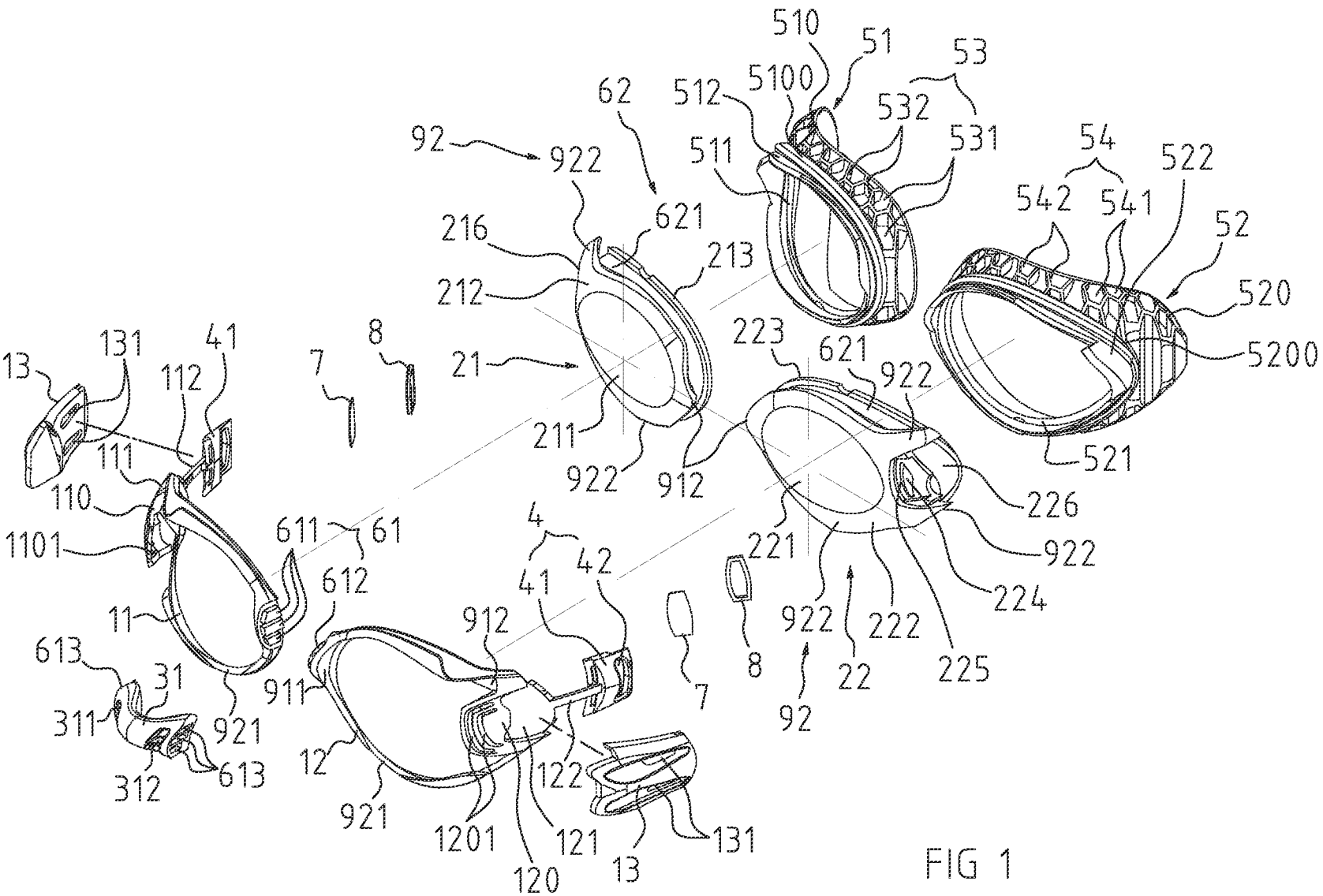
FIG. 1 and FIG. 2 are exploded diagram and stereoscopic diagram of the swimming goggles of the present invention, respectively.
Figure 7:
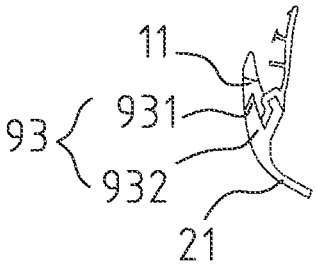
FIGS. 7 and 8 are two oblique 7-7 and 8-8 cross-sectional views of the swimming goggles shown in FIG. 3, which is placed at the left edge of the lens.

Please refer to FIG. 1, which is exploded view of the swimming goggles 1 of the present invention. It can be seen that the swimming goggles 1 of the present invention take two frames 11, 12 as the core, and the lenses 21, 22, the nose bridge connecting part 31, the headband device 4, the protective pads 51 and 52, etc. are assembled into a whole. The first assembly 61 is arranged between the two frames 11, 12 and the nose bridge connecting part 31. A second assembly 62 is arranged between each of the frames 11, 12, each of the lenses 21, 22 and the protective pads 51, 52. In addition, four fitting parts 91, 92, 93, 94 are provided between the frames 11, 12 and the lenses 21, 22 (as shown in FIGS. 5 and 7).

Figure 2:
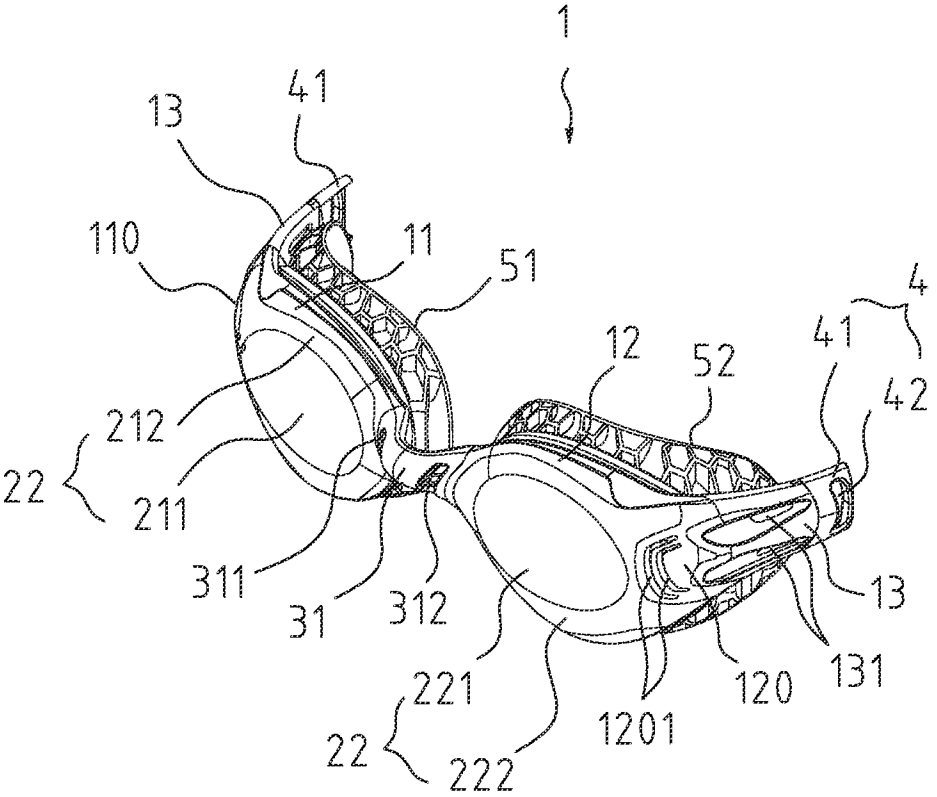
Figure 5:
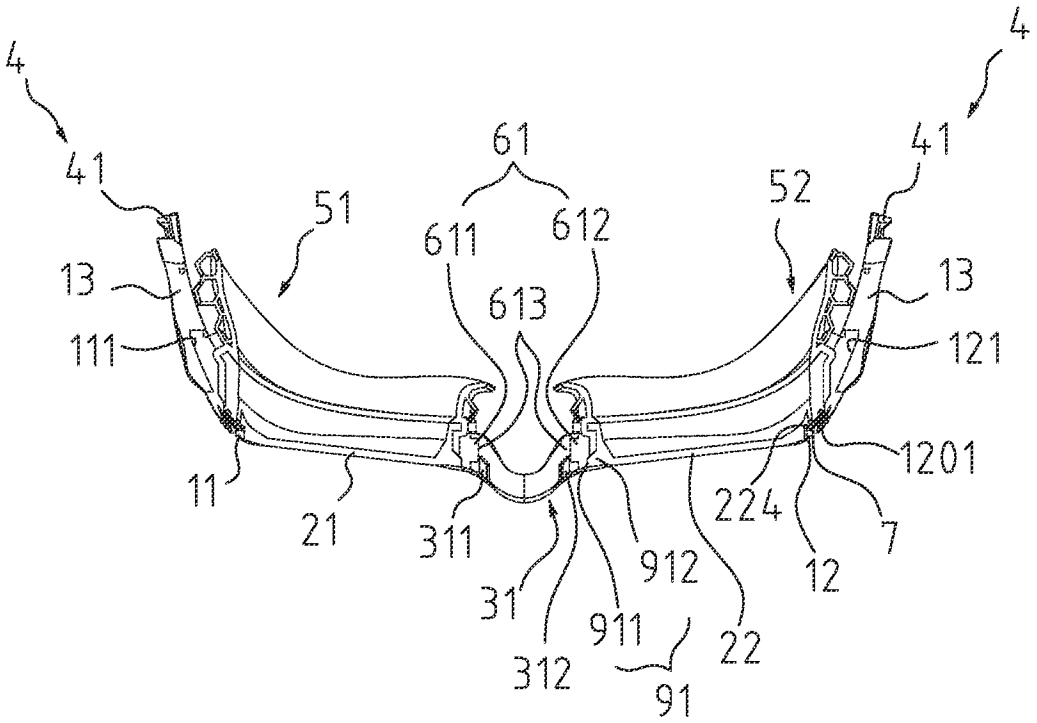
FIG. 5 is a transverse 5-5 cross-sectional view of the swimming goggles shown in FIG. 3, which is placed near the top of the lens.

Please refer to FIG. 1, FIG. 2 and FIG. 5. The two frames 11, 12 are provided with protective covers. The protective covers are tongue pieces 110, 120 and the tongue pieces 110, 120 are provided with a plurality of hollow grooves 1101, 1201 for ventilation. Furthermore, the frames 11, 12 where the tongue pieces 110, 120 are located form lower concave surfaces 111, 121, which are covered with thermoplastic rubber (TPR) and protrude an extension section 13, and the end of the extension section 13 is connected with the side buckle 41 of the headband device 4. The side buckle 41 has a through hole 42 for threading the headband (not shown) of the headband device 4 (note that the threading hole for threading the headband can be provided on the frames 11, 12 at the end away from the hollow groove of the tongue if the frames 11, 12 are not provided with the extension section 13, or otherwise provided on the lens 21, 22 which is away from the later-described ventilation window). In addition, the extension section 13 is provided with an elongated threading hole 131, which makes the extension section more flexible. In addition, the frames 11, 12 and the side buckle 41 are connected by a connecting rib 112, 122, and the connecting rib 112, 122 is integrally formed with the frames 11, 12 and the side buckle 41 by the same material. For example, the extension section 13 is endowed with excellent bending flexibility due to the characteristics of thermoplastic rubber and the arrangement of the elongated threading hole 131, which can provide comfortable wearing for users with different facial contours.

Referring again to FIGS. 1 and 5, each of the lenses 21, 22 includes front planes 211, 221 and torus 212, 222 integrally extending along the periphery of the front plane 211, 221. And lips 213, 223 integrally extending along the peripheries of the torus 212, 222, and the length of the front planes 211, 221 on the X-axis is longer than the width on the Y-axis. The side of the torus 212, 222 opposite to the X axial direction of the front planes 211, 221 is provided with ventilation windows 214, 224 (as shown in FIGS. 1, 5), and the ventilation windows 214, 224 are connected by the waterproof-ventilation film 7. The material of the waterproof-ventilation film 7 is Polytetrafluoroethylene (PTFE) that has a plurality of watertight but non-airtight micropores with the pore diameter being 0.1~0.5 μm. In addition, concave platforms 215, 225 are arranged at the peripheries of the ventilation windows 214, 224, which allows for the foam 8 to be assembled on, and the foam 8 has been assembled with the waterproof-ventilation film 7 in advance before being assembled on the concave platforms 215, 225. Furthermore, concave surfaces 216, 226 are formed on the torus 212, 222 of the lenses 21, 22 where the ventilation windows 214, 224 are located, and the aforementioned tongue pieces 110, 120 (protective covers) are arranged along the concave surfaces 216, 226. After the lenses 21, 22 are assembled with the frames 11, 12, the tongue pieces 110, 120 remain spaced from the concave surfaces 216, 226 and cover on the ventilation windows 214, 224 (as shown in FIG. 5).

The protective pads 51, 52 are made of Silicone and are suction pads. As shown in FIG. 1, the protective pads 51, 52 are provided with assembly grooves 511, 521 for assembling with the convex lips 223 (or 213) of the lens 22 (or 21). In addition, the protective pads 51, 52 are provided with pressing lips 512, 522 along the assembly grooves 511, 521, respectively. In addition, a buffer 53,54 are arranged between a face attaching part 510,520 and a connection part 5100,5200 of each of the protective pads 51,52, respectively. Each of the buffer bodie 53, 54 is composed of a plural of chambers 532, 542 and opening 531, 541, respectively. The openings 531, 541 of the respective chambers 532, 542 are geometric, such as honeycomb, or elliptical, elliptical, etc. in practice, so as to absorb the squeezing and absorbing force upon wearing. The form of the protective pad is not limited to this embodiment only. It is also possible for the present invention to adopt a protective pad without a buffer, or adopt a wavy-shaped protective pad which further fits the contour of the eye socket on the face-sticking side thereof.

For the assembly of the swimming goggles of the present invention, please refer to FIG. 1. The first assembly 61 between the two frames 11, 12 and the nose bridge connecting part 31 connects the two frames 11, 12 through the nose bridge connecting part 31. In addition, the two frames 11, 12 are combined with the lenses 21, 22 and the protective pads 51, 52 through the second assembly 62 between each of the frames 11, 12 and each of the lenses 21, 22. That is, as shown in FIG. 5, the first assembly 61 is assembled into a whole between the two frames 11, 12 made of Polycarbonate (PC), Polypropylene (PP) or Polyamide and the nose bridge connecting part 31 made of Thermoplastic Rubber (TPR) by molding technology, wherein the frames 11, 12 are provided with a plurality of convex bodies 611, 612, and the side of the nose bridge connecting part 31 is provided with a plurality of grooves 613 corresponding to the convex bodies 611, 612, so that the frames 11, 12 and the nose bridge connecting part 31 have a better gripping effect with the aid of the convex bodies 611, 612 and the grooves 613 during molding and coating. In addition, the nose bridge connecting part 31 is provided with grooves 311, 312 on both sides close to the frames 11, 12, respectively, which endows the nose bridge connecting part 31 with more bending flexibility. For example, the two frames 11, 12 are integrally combined with the nose bridge connecting part 31, and the nose bridge connecting part 31 has excellent bending flexibility due to the characteristics of TPR material and the arrangement of the grooves 311, 312, which can provide comfortable wearing experience for users with different sizes of nose bridges.

Figure 3:
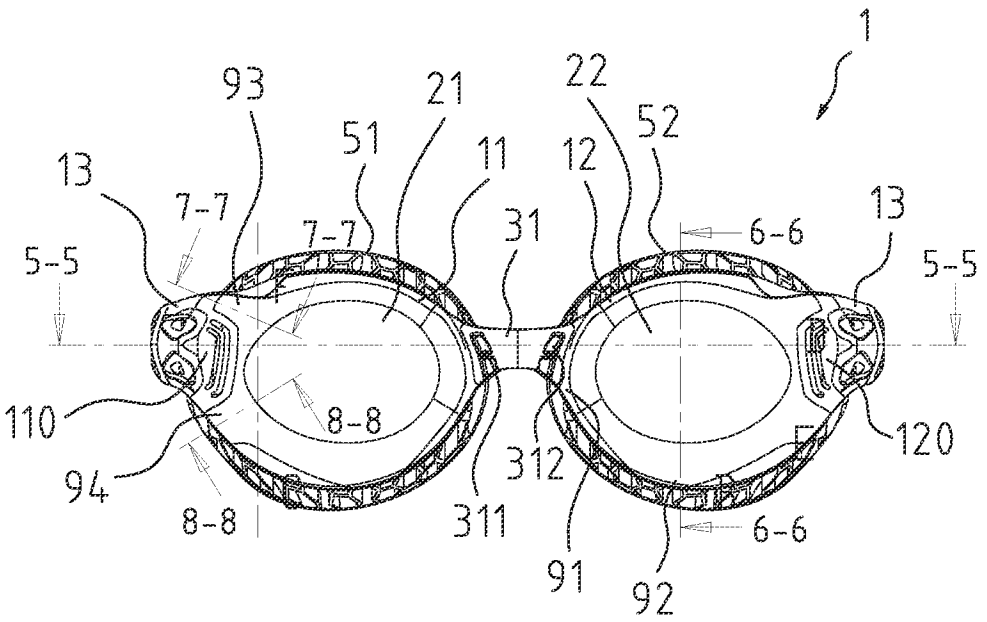
FIGS. 3 to 4 are front and rear views of FIG. 2, respectively.
Figure 4:
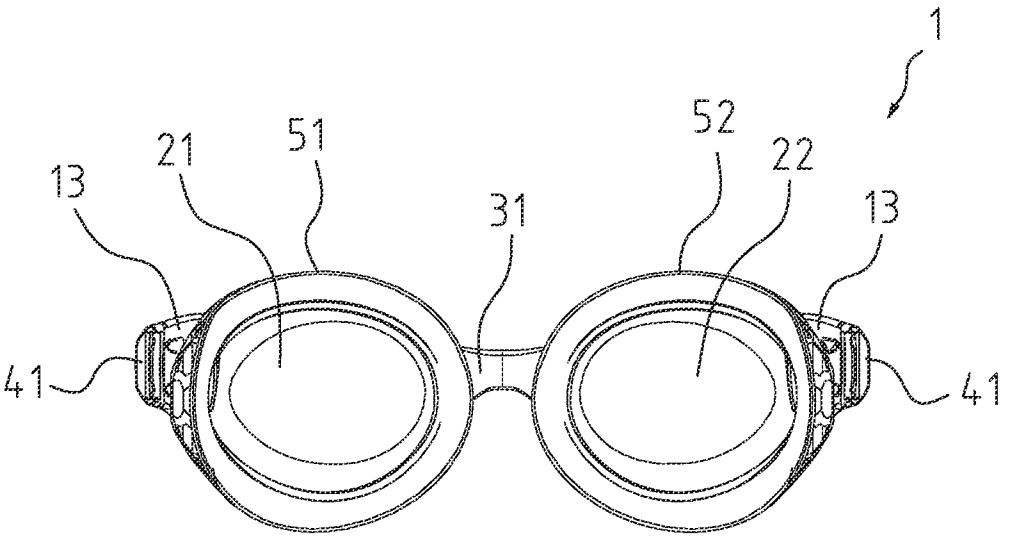
Figure 6:
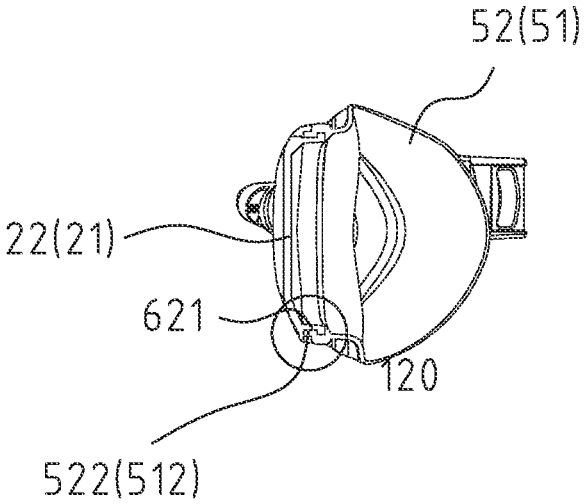
FIG. 6 is a longitudinal 6-6 sectional view of the swimming goggles shown in FIG. 3, which is placed near the center of the lens.

Please refer to FIG. 3 for the second assembly 62, in conjunction with FIG. 6 and FIG. 10, the lens 22 (or 21) is provided with a groove 621, and the width W1 of the groove 621 is slightly smaller than the width W2 of the frames 11, 12, plus the peripheral length W3 of the lens 22 (or 21) and the protective pad 52 (or 51) (as shown in FIG. 10). When assembling, firstly, the assembly groove 521 (or 511) of the protective pad 52 (or 51) is assembled on the lip 223 (or 213) of the lens 22 (21). At this time, as shown in FIG. 10, the width W1 of the groove 621 accommodates the peripheral length W3 of the protective pad 52 (or 51), and the remaining width is slightly smaller than the width W2 of the frame 12 (or 11), i.e., W1<W2+W3. When assembling, the frame 12 (or 11) is assembled in the remaining width of the groove 621 in an interference manner, and the pressing lip 522 (or 512) is pressed, so that the protective pad 52 (or 51) is fastened into the groove 621, so that the two frames 12 (or 11), the lens 22 (21) and the protective pad 52 (or 51) can be firmly fixed.

Figure 8:
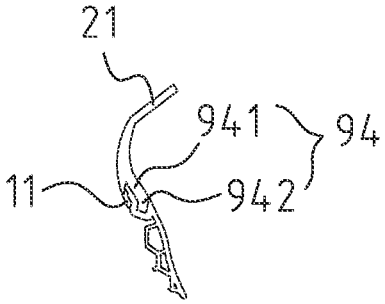

In addition, please refer to the cross-sectional lines of FIGS. 1 and 3 in conjunction with FIGS. 5, 7 to 8. As shown in the cross-sectional lines of FIG. 3, four fitting parts 91, 92, 93, 94 are arranged between the frames 11, 12 and the lenses 21, 22 of the swimming goggles 1 of the present invention include: a fitting part 91 (as shown in FIG. 5, only one side of the frame 12 and the lens 22 is shown, and the frame 11 on the other side has the same structure as the lens 21); a fitting portion 92 in Y-axial direction (see FIGS. 1 and 3, as the position of section line 6-6 in FIG. 3 is overlapped with other later described components in FIG. 6, it is more clear to refer to FIG. 1); a fitting parts 93 on both sides of the extension section 13 (as shown in FIG. 7, the cross-section line 7-7); and a fitting part 94 (as shown in FIG. 8, the cross-section line 8-8). With the aid of the four fitting parts 91, 92, 93, 94, and the frames 11, 12 can be more stably connected with the lenses 21, 22.

Figure 9:
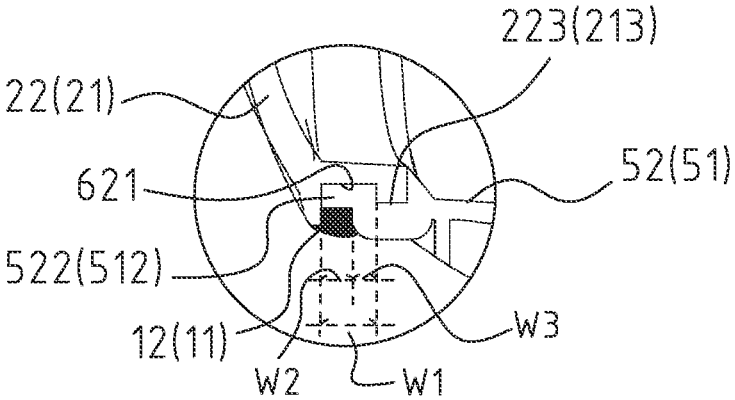
FIG. 9 is an enlarged partial view of the circle in FIG. 6.

With reference to FIG. 3 and FIG. 5, the fitting part 91 is provided with a first insert groove 911 on one side of the frames 11, 12 adjacent to the nose bridge connecting part 31, and the raised ridge 912 of the opposite lens 21, 22 can be assembled with the first insert groove 911, which can make the frames 11, 12 and the lenses 21, 22 more stably assembled in the X-axial direction. As shown in FIG. 1, the fitting part 92 is provided with a convex edge 922 at the center of the lenses 21, 22, and the frames 11, 12 are provided with a second insert groove 921 opposite to each other, so that the frames 11, 12 and the lenses 21, 22 can be assembled more stably in the Y-axis. As shown in FIG. 3, FIG. 8 and FIG. 9, the fitting parts 93, 94 are respectively arranged between the frame 11 and the lens 21 on both sides of the extension section 13, respectively, and are provided with a third insert groove 931 and a fourth insert groove 941. The embedded legs 932, 942 which can be inserted into the third insert groove 931 and the fourth insert groove 941 are respectively provided corresponding to the lens 21, so that the frame 11, 12 and the lens 21, 22 can be connected with each other, making the oblique connection of the frame 11, 12 and the lens 21, 22 more stable.

As mentioned above, after the swimming goggles 1 of the present invention are fully assembled as shown in FIG. 2, the two frames 11, 12 combine the lenses 21, 22 of the swimming goggles, the nose bridge connecting part 31, the side buckle 41 of the headband device 4, the protective pads 51, 52 and other components as a whole. As shown in the figures, the waterproof-ventilation film 7 on the lenses 21, 22 is shielded and protected by the tongue pieces 110, 120 (functioning as protective covers), which prevents from improper bumping of external force. The nose bridge connecting part 31 has excellent bending flexibility due to the characteristics of thermoplastic rubber material and the arrangement of the grooves 311, 312, which can provide comfortable wearing experiences for users with different sizes of nose bridges. In addition, the extension section 13 is endowed with excellent bending flexibility due to the characteristics of TPR and the arrangement of the elongated threading hole 131, which can provide users with different facial contours with comfortable wearing experience. Therefore, the swimming goggles 1 of the present invention not only have waterproof and ventilation effect, but also can serve the protective purposes for the waterproof and ventilation film on the lens as well as provide comfortable wearing experience.

To sum up, the swimming goggles of the present invention can ensure the innovative purpose and meet the requirements of patent applications. However, what are described above are merely preferred embodiments of the present invention. Modifications and changes made according to the present invention shall fall into the scope of this patent application.

What is claimed is:

1. Swimming goggles comprising two frames, two lenses, a nose bridge connecting part, two protective pads and a headband device, and using the two frames as a core that combines the two lenses, the nose bridge connecting part, the two protective pads and the headband device as a whole; wherein the nose bridge connecting part connects the two frames; the two lenses are respectively assembled with the two frames, and each of the two lenses is provided with a ventilation window with a waterproof-ventilating film; the two protective pads are respectively assembled on the two lenses; and the headband device is connected to the frames or the two lenses; the swimming goggles characterized in that:

each of the frames is provided with a protective cover relative to the ventilation window of each of the lenses.

2. The swimming goggles according to claim 1, wherein the protective pad is a suction pad, and the protective pad has an assembly groove; and each of the lenses includes:

a front plane and an torus integrally extending along the periphery of the front plane; and a convex lip integrally extending along the periphery of the torus for assembling with the assembly groove of the protective pad, wherein the front plane is wider in X-axial direction than in Y-axial direction, and one side of the torus opposite to the X-axis of the front plane is provided with the ventilation window.

3. The swimming goggles according to claim 2, wherein a concave surface is formed on the torus of the lens where the ventilation window is located, the ventilation window is located in the concave surface, and the periphery of the ventilation window is provided with a concave platform for fixing a waterproof and ventilation film.

4. The swimming goggles according to claim 1, wherein the waterproof-ventilation film is made of Polytetrafluoroethylene (PTFE) and has a plurality of water-tight but non-airtight micropores, and the pore diameter of the micropores is 0.1-0.5 μm.

5. The swimming goggles according to claim 3, wherein the protective cover on the frame is a tongue piece, and the tongue piece is integrally arranged along the concave surface of the frame so as to keep distant from the concave surface and cover thereon, and the tongue piece is provided with a plurality of hollow grooves for ventilation.

6. The swimming goggles according to claim 5, wherein the concave surface of the frame or the lens is located at the end away from the hollow groove of the tongue piece, and is provided with a through hole for the headband of the headband device to pass through.

7. The swimming goggles according to claim 5, wherein the frame in which the tongue piece is located is integrally provided with an extension section at the end away from the hollow groove, and the end of the extension section is provided with a threading hole for the headband of the headband device.

8. The swimming goggles according to claim 7, wherein the frame and the tongue piece are made of polycarbonate (PC) Polypropylene (PP) or Polyamide.

9. The swimming goggles according to claim 8, wherein each of the frames forms a lower concave surface opposite to the tongue piece, and the lower concave surface is covered with thermoplastic rubber (TPR) and protrudes with an extension section, and the tail end of the extension section is connected with a side buckle of the headband device, and the side buckle has a threading hole for the headband of the headband device to pass through.

10. The swimming goggles according to claim 9, wherein each of the frame and each of the side buckle is connected by a connecting rib, and the frame, the side buckle and the connecting rib are integrally formed with the same material.

11. The swimming goggles according to claim 9, wherein the extension section is provided with an elongated threading hole, providing the extension section with more bending flexibility.

12. The swimming goggles according to claim 2, wherein a first assembly is arranged between each of the frames and the nose bridge connecting part, and a second assembly is arranged among each of the frames, each of the lenses, and the protective pad.

13. The swimming goggles according to claim 12, wherein the first assembly combines the frames made of Polycarbonate (PC), Polypropylene (PP) or Polyamide (polyamide) with the nose bridge connecting part made of thermoplastic rubber (TPR) through molding technology.

14. The swimming goggles according to claim 13, wherein the first assembly is further provided with a plurality of convex bodies and grooves which are connected with each other between each of the frames and a side of the nose bridge connecting part, so that during molding, the convex bodies and grooves make each of the frames and the nose bridge connecting part have increased gripping effect.

15. The swimming goggles according to claim 13, wherein the nose bridge connecting part is close to both sides of each of the frames, and is provided with at least one groove to make the nose bridge connecting part have increased flexibility.

16. The swimming goggles according to claim 13, wherein the second assembly forms groove along the convex lip of the lens, and the groove is concave towards the torus of the lens; the width of the groove is smaller than the width of the frame plus the peripheral length of the contour of the protective pad that is assembled with the lens, so that the frame is firmly assembled in the groove in an interference manner during assembly.

17. The swimming goggles according to claim 16, wherein each of the protective pads is provided with a pressing lip along the assembly groove, and after each of the frames is assembled in the groove in the interference manner, the pressing lip is fastened and pressed in the groove by each of the frames.

18. The swimming goggles according to claim 16, wherein two fitting parts are arranged between each of the frames and each of the lenses, and the two fitting parts are respectively located along the X-axis and the Y axis relative to each of the lenses, and each of the fitting part located along the X-axis is provided with a first insert groove on each of the frames adjacent to the nose bridge connecting part, and is provided with a raised ridge relative to each of the lenses; and each of the fitting part located in the Y-axis is provided with a convex edge at the center of each of the lenses, and a second insert groove is opposite to each of the frames.

19. The swimming goggles according to claim 16, wherein two fitting parts are arranged between each of the frames and each of the lenses, and the two fitting parts are respectively arranged between each of the frames and each of the lenses on both sides of the extension section; and the two sides of the frame are respectively provided with a third fitting groove and a fourth fitting groove, and are provided, corresponding to each of the lenses, with an embedded feet that are respectively able to be embedded in the third and the fourth fitting grooves.

20. The swimming goggles according to claim 2, wherein a buffer is arranged between a face attaching part and a connection part of each of the protective pad, respectively, so as to absorb squeezing and adsorption force upon wearing.

* * * * *